US009887486B2

(12) United States Patent
Okamoto

(10) Patent No.: US 9,887,486 B2
(45) Date of Patent: Feb. 6, 2018

(54) CONNECTOR

(71) Applicant: Sumitomo Wiring Systems, Ltd., Yokkaichi, Mie (JP)

(72) Inventor: Masaki Okamoto, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/508,952

(22) PCT Filed: Aug. 4, 2015

(86) PCT No.: PCT/JP2015/072017
§ 371 (c)(1),
(2) Date: Mar. 6, 2017

(87) PCT Pub. No.: WO2016/047276
PCT Pub. Date: Mar. 31, 2016

(65) Prior Publication Data

US 2017/0288336 A1 Oct. 5, 2017

(30) Foreign Application Priority Data

Sep. 25, 2014 (JP) ..... 2014-194827

(51) Int. Cl.
*H01R 13/52* (2006.01)
*H01R 13/6581* (2011.01)

(52) U.S. Cl.
CPC ..... *H01R 13/5219* (2013.01); *H01R 13/5205* (2013.01); *H01R 13/6581* (2013.01)

(58) Field of Classification Search
CPC ..... H01R 13/5219
See application file for complete search history.

(56) References Cited

U.S. PATENT DOCUMENTS 4,193,655 A 3/1980 Herrmann, Jr.
4,640,567 A 2/1987 Lundergan
(Continued)

FOREIGN PATENT DOCUMENTS

JP 9-147966 6/1997
JP 11-162555 6/1999
JP 2009-105011 5/2009

OTHER PUBLICATIONS

European Search Report dated June 20, 2017.
International Search Report dated Sep. 15, 2015.

*Primary Examiner* — James Harvey
(74) *Attorney, Agent, or Firm* — Gerald E. Hespos; Michael J. Porco; Matthew T. Hespos

(57) ABSTRACT

A waterproof connector is a connectable to a device-side connector (80) and has a housing (30) with a fitting (34) that can fit into an outer tube (82) of the device-side connector (80). A connector seal ring (36) is fit on an outer peripheral surface of the fitting (34) and is held resiliently in close contact with the outer tube (82) and the fitting (34). Individual terminal accommodating portions (37) are provided in the housing (30) and can fit into device-side cavities (84) provided in the device-side connector (80). Individual seal rings (38) are fitted on outer peripheral surfaces of the individual terminal accommodating portions (37) and are held resiliently in close contact with inner peripheral surfaces of the device-side cavities (84) and the individual terminal accommodating portions (37). The connector seal rings (36) and the individual seal rings are displaced in a front-rear direction.

4 Claims, 6 Drawing Sheets

(56) References Cited

U.S. PATENT DOCUMENTS

| | | | | |
|---|---|---|---|---|
| 5,810,615 | A * | 9/1998 | Ohta | H01R 13/5219 439/313 |
| 6,053,754 | A | 4/2000 | Kano | |
| 2002/0115345 | A1 * | 8/2002 | Nakamura | H01R 13/5219 439/587 |
| 2012/0094539 | A1 * | 4/2012 | Ooki | C08L 53/025 439/625 |

* cited by examiner

CONNECTOR

BACKGROUND

1. Field of the Invention

A technique disclosed by this specification relates to a connector.

2. Description of the Related Art

Japanese Unexamined Patent Publication No. 2009-105011 discloses a connector for individually waterproofing electrodes. This connector is connectable to a mating connector and includes a housing for holding a plurality of contacts and a seal provided in the front end of the housing. The seal is provided with first through holes. When the mating connector and the housing are connected, surrounding portions for surrounding base ends of mating contacts in the mating connector are inserted through the first through holes to seal between the surrounding portions and the housing to waterproof each electrode individually.

According to the above-described configuration, sealing is provided between the mating connector and the housing by the seal provided in the front end of the housing. Thus, the mating connector and the housing may wrench and rattle each other with the position of the seal member acting as a fulcrum and contact parts between the mating connector and the contacts may slide and abrade.

A technique for suppressing the abrasion of contact parts by suppressing rattling between connectors is disclosed in this specification.

SUMMARY

This specification is directed to a connector that is connectable to a mating connector. The connector is provided with a housing including a fitting portion that is fittable into the mating connector. A connector resilient member is fit on an outer peripheral surface of the fitting portion and is configured to be held resiliently in close contact with the mating connector and the fitting portion when the fitting portion is fit into the mating connector. Terminal accommodating portions are provided in the housing and are configured respectively to accommodate terminals to be connected to mating terminals that are fit respectively into mating cavities in the mating connector. The connector also has individual resilient members to be fit on outer peripheral surfaces of the individual terminal accommodating portions and configured to be held resiliently in close contact with inner peripheral surfaces of the mating cavities and the individual terminal accommodating portions when the individual terminal accommodating portions are fit into the mating cavities. The connector resilient member and the individual resilient members are displaced in a connecting direction.

The resilient members are held resiliently in close contact with the mating connector and the connector at two positions in the connecting direction by displacing the connector resilient member and the individual resilient members in the connecting direction. Thus, the mating connector and the connector can be prevented from wrenching and rattling with the resilient members acting as fulcrums, for example, as compared to the case where a resilient member is held in close contact with the mating connector and the connector at one position in the connecting direction. In this way, contact parts between the mating terminals and the terminals can be prevented from sliding to be abraded.

Further, the displacement of the connector resilient member and the individual resilient members in the connecting direction disperses connection resistance when connecting the mating connector and the connector as compared to the case where the connector resilient member and the individual resilient members are arranged at the same position in the connecting direction.

The connector resilient member may be a connector seal made of a resilient material and configured to stop water between the mating connector and the fitting portion by being held resiliently in close contact with the mating connector and the fitting portion over the entire periphery. Additionally, the individual resilient member may be individual seals made of a resilient material and configured to stop water between the inner peripheral surface of the mating cavity and the individual terminal accommodating portion by being held resiliently in close contact with the inner peripheral surface of the mating cavity and the individual terminal accommodating portion over the entire periphery.

According to this configuration, the connector seal configured to stop water between the mating connector and the fitting portion and the individual seals configured to stop water between the inner peripheral surfaces of the mating cavities and the individual terminal accommodating portions can be also used as rattling suppressing members for preventing rattling of the mating connector and the connector. In this way, the number of components can be reduced, for example, as compared to the case where a rattling suppressing member is provided separately.

Either the connector resilient member or the individual resilient members may be arranged on one end part in the connecting direction of an area where the fitting portion is arranged, and the other(s) may be arranged on the other end part in the connecting direction of the area where the fitting portion is arranged.

According to this configuration, the rattling of the mating connector and the connector with the positions of the resilient members acting as fulcrums can be suppressed further, for example, as compared to the case where the connector resilient member and the individual resilient members are displaced slightly in the connecting direction.

The fitting portion may hold a shield shell to be held in contact with a mating shell provided in the mating connector. Additionally, the connector resilient member and the individual resilient members may be arranged in areas at both sides in the connecting direction of a position where the mating shell and the shield shell are in contact.

According to this configuration, not only contact parts between the mating terminals and the terminals, but also the mating shell and the shield shell can be prevented from sliding to be abraded. Thus, this configuration is particularly effective when the connector includes a shield shell.

According to by this specification, it is possible to suppress the abrasion of contact parts by suppressing rattling between connectors.

DETAILED DESCRIPTION

An embodiment is described with reference to FIGS. 1 to 6.

A waterproof connector (an example of a "connector") 10 to be connected to a device-side connector (an example of a "mating connector") 80 provided in a device to be installed in a vehicle is illustrated in this embodiment. Note that, in the following description, a vertical direction is based on a vertical direction in FIGS. 1 and 3. Further, a front-rear direction is based on a lateral direction in FIGS. 3 and 4 and sides of the waterproof connector 10 and the device-side connector 80 to be connected to each other are referred to as front sides.

Figure 2:
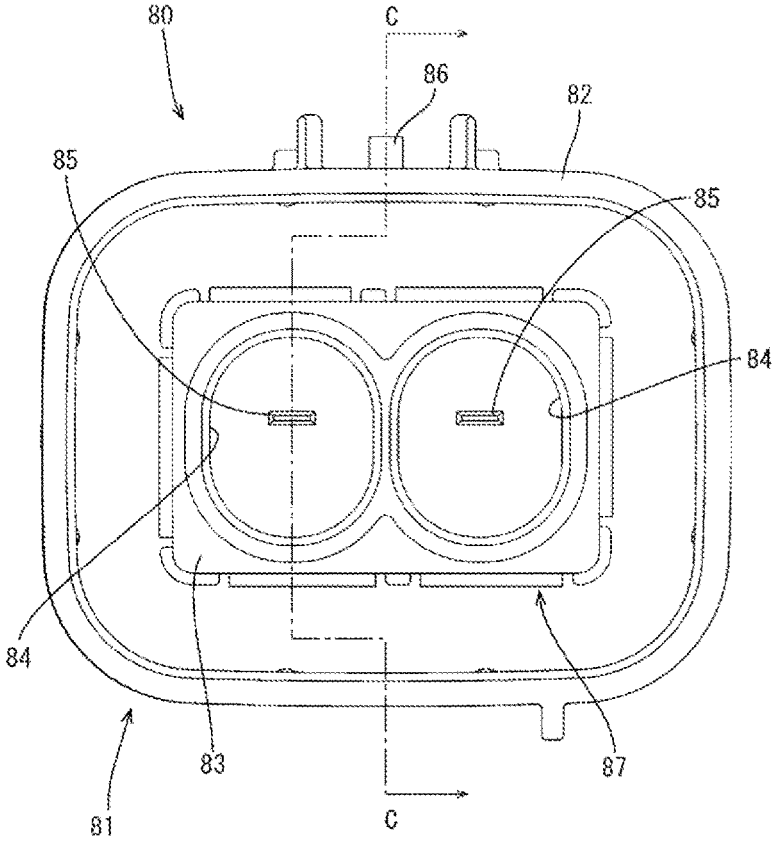
FIG. 2 is a front view of a device-side connector.
Figure 3:
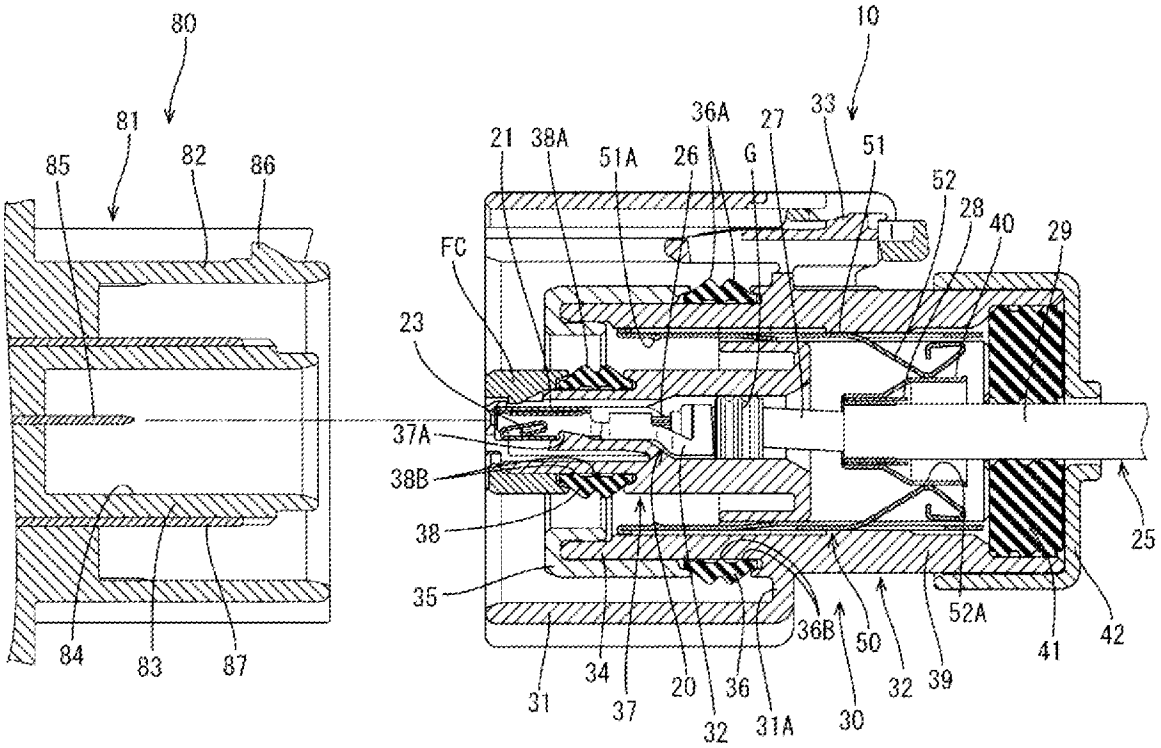
FIG. 3 is a section, corresponding to a cross-section along A-A of FIG. 1 and a cross-section along C-C of FIG. 2, showing a state before the device-side connector and the waterproof connector are connected.
Figure 4:
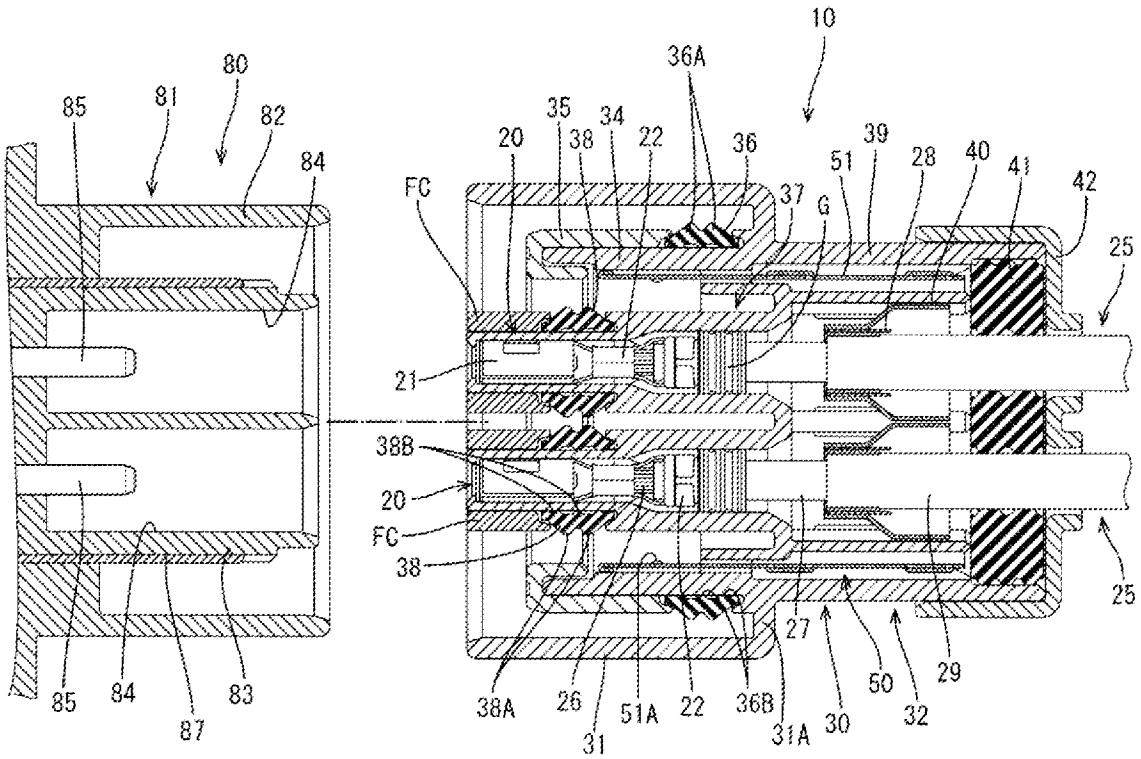
FIG. 4 is a section, corresponding to a cross-section along B-B of FIG. 1, showing the state before the device-side connector and the waterproof connector are connected.

As shown in FIGS. 2, 3 and 4, the device-side connector 80 includes a device-side housing (corresponding to a "mating housing") 81 made of synthetic resin and connectable to the waterproof connector 10. The device-side housing 81 is formed such that an inner tube 83 including two device-side cavities (an example of "mating cavities") 84 is provided inside a substantially rectangular outer tube 82.

The two device-side cavities 84 are provided side by side in a width direction, and male terminals (an example of "mating terminals") 85 in the form of flat plates projecting forward from a back wall are accommodated respectively in the device-side cavities 84.

A lock 86 is formed on a front end part of the upper surface of the outer tube 82, and a tubular device-side shell (an example of a "mating shell") 87 is mounted on the outer periphery of the inner tube 83. The device-side shell 87 is made of metal excellent in conductivity and surrounds the inner tube 83 over the entire periphery.

As shown in FIGS. 1 and 3 to 6, the waterproof connector 10 includes female terminals (an example of "terminals") 20 connectable to the male terminals 85 of the device-side connector 80, a housing 30 configured to accommodate a plurality of female terminals 20 and to be connected to the device-side housing 81 and a shield shell 50 configured to collectively surround the female terminals 20 by being accommodated into the housing 30.

The female terminal 20 is formed by press-working a metal plate material excellent in conductivity and, as shown in FIGS. 3 to 6, is connected to an end of a shielded cable 25.

The shielded cable 25 includes a core 26, an insulating inner coating 27, a braided wire 28 and an insulating outer coating 29 concentrically arranged from an inner side, and the end of the shielded cable 25 is exposed successively from the core 26 to the braided wire 28.

The female terminal 20 is formed, for example, by press-working a metal plate material that is excellent in conductivity. The female terminal 20 has a terminal connecting portion 21 and a wire connecting portion 22 provided behind the terminal connecting portion 21. The terminal connecting portion 21 is to be connected to the male terminal 85 of the device-side connector 80. The wire connecting portion 22 is crimped to the core 26 and to the inner coating 27 of the shielded cable 25 for connecting the female terminal 20 to the shielded cable 25, and a rubber plug G is fit externally on the inner coating 27.

Figure 5:
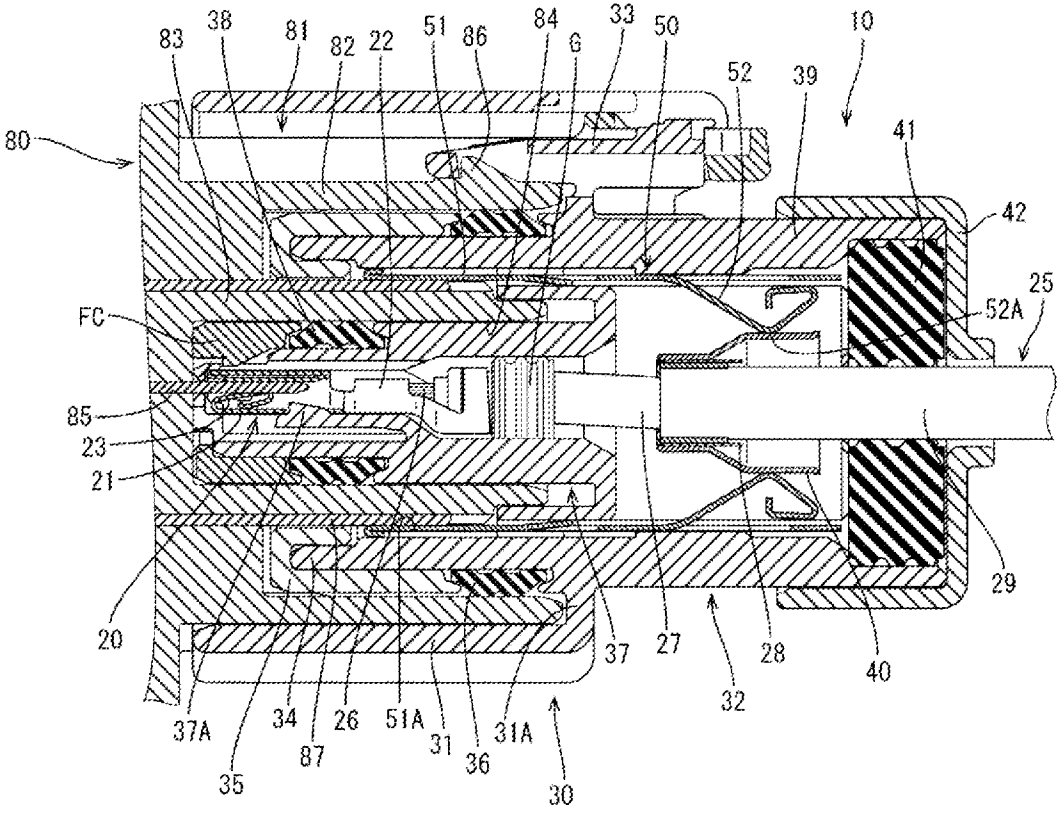
FIG. 5 is a section, corresponding to a cross-section of FIG. 3, showing a state after the device-side connector and the waterproof connector are connected.

As shown in FIGS. 3 and 5, the terminal connecting portion 21 is in the form of a rectangular tube open forward and rearward, and the male terminal 85 of the device-side connector 80 is inserted into the terminal connecting portion 21 from the front. A resilient contact piece 23 is provided in the terminal connecting portion 21 and is configured to resiliently contact the male terminal 85 of the device-side connector 80. As shown in FIG. 5, this resilient contact piece 23 resiliently contacts the male terminal 85 and vertically sandwiches the male terminal 85 together with an upper plate of the terminal connecting portion 21 when the male terminal 85 is inserted into the terminal connecting portion 21. Thus, the female terminal 20 and the male terminal 85 are connected electrically.

Figure 6:
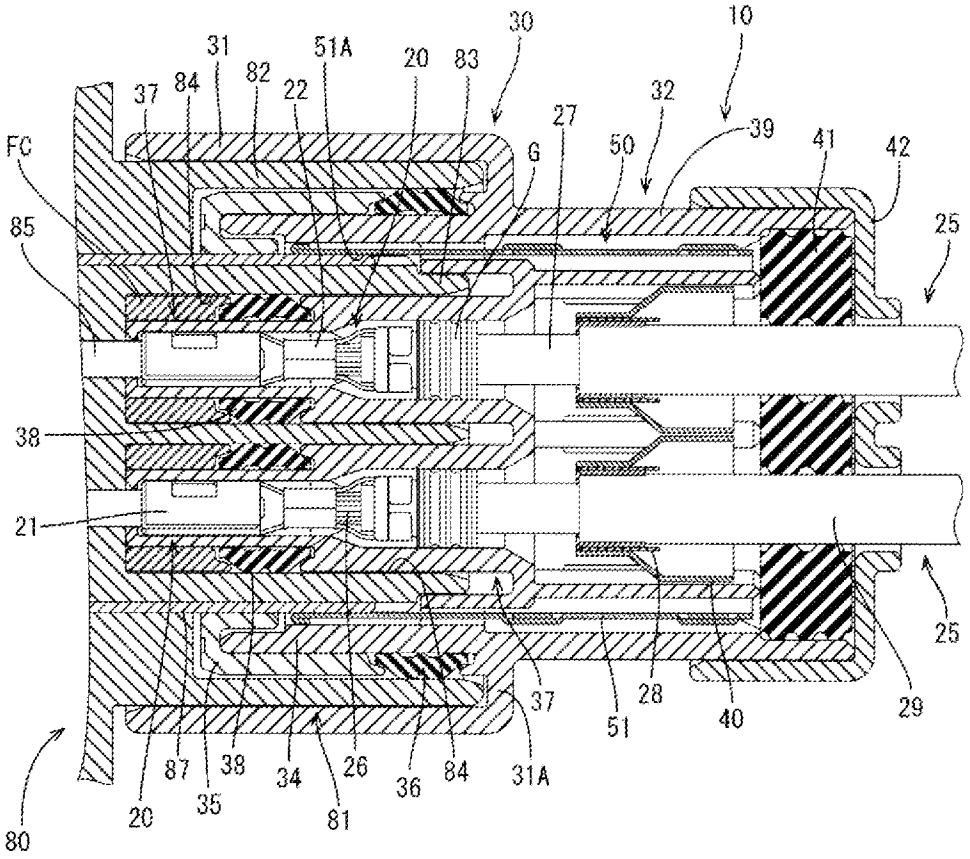
FIG. 6 is a section, corresponding to a cross-section of FIG. 4, showing the state after the device-side connector and the waterproof connector are connected.

The housing 30 is made of synthetic resin and, as shown in FIGS. 5 and 6, includes a receptacle 31 into which the device-side housing 81 of the device-side connector 80 is fit from the front, and a housing body 32 substantially in the form of a rectangular tube penetrates through a back wall 31A of the receptacle 31 in the front-rear direction.

As shown in FIGS. 1 and 3 to 6, the receptacle 31 is open forward and is long in the width direction. A lock arm 33 is formed on the top of the receptacle 31 and is lockable to the lock 86 of the device-side housing 81 in the front-rear direction. The lock arm 33 is locked to the lock 86 in the front-rear direction to lock the housing 30 and the device-side housing 81 in a connected state, as shown in FIG. 5, when the receptacle 31 and the device-side housing 81 are fit properly.

The housing body 32 arranged in the receptacle 31 serves as a fitting 34 to be fit between the outer tube 82 and the inner tube 83 of the device-side housing 81.

Figure 1:
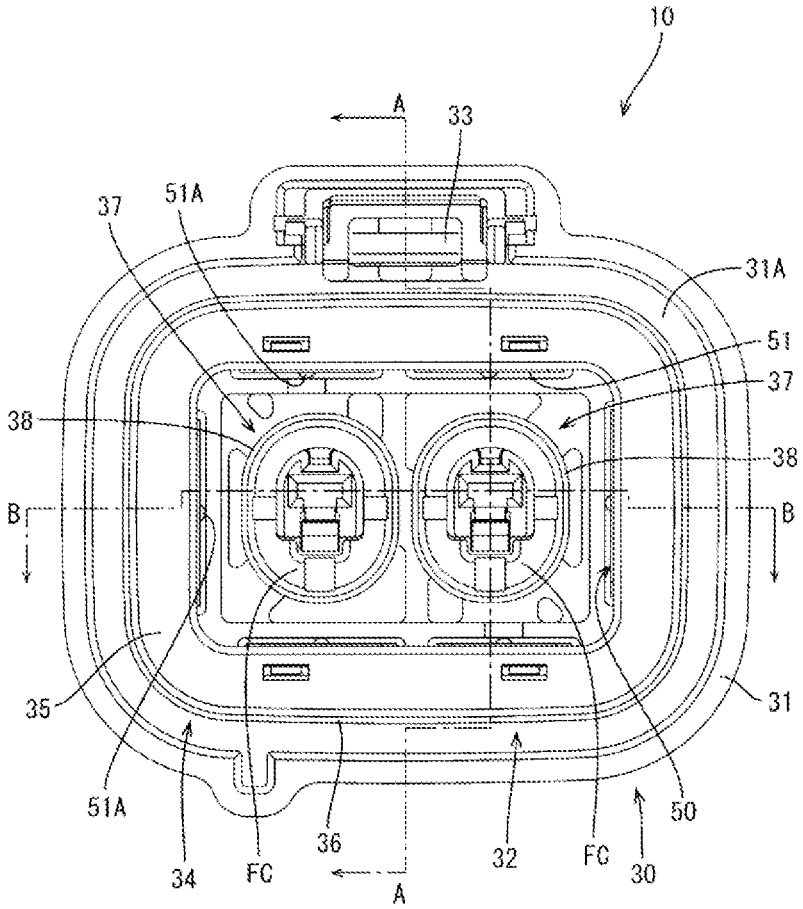
FIG. 1 is a front view of a waterproof connector.

The fitting 34 is substantially in the form of a rectangular tube with four rounded corners, as shown in FIG. 1. An annular connector seal ring (an example of a "connector resilient member" and a "connector seal member") is fit on the outer peripheral surface of the fitting 34, as shown in FIGS. 3 to 6, and is prevented from coming off forward by a seal presser 35. The connector seal ring 36 is made of an oil-containing resilient material. Outer peripheral lips 36A are provided on the outer peripheral surface of the connector seal ring 36 and inner peripheral lips 36B are provided on the inner peripheral surface of the connector seal ring 36. When the fitting 34 is fit into the outer tube 82, the outer peripheral lips 36A of the connector seal ring 36 are held resiliently in close contact with the inner peripheral surface of the outer tube 82 over the entire periphery and the inner peripheral lips 36B are held resiliently in close contact with the outer peripheral surface of the fitting 34 over the entire periphery. In this way, water is stopped between the inner peripheral surface of the outer tube 82 and the outer peripheral surface of the fitting 34 by the connector seal ring 36.

The seal presser 35 is formed to cover the front surface, the inner peripheral surface and the outer peripheral surface of an opening edge part of the front end of the fitting 34, and is held on the fitting 34 by locking an unillustrated locking projection provided on the seal presser 35 and an unillustrated locked portion on the fitting 34 in the front-rear direction.

Two individual terminal accommodating portions 37 are provided side by side in the width direction inside the fitting 34 for individually accommodating the female terminals 20. The individual terminal accommodating portions 37 are substantially of circular tubes extending forward from a back part of the fitting 34 and are long in the front-rear direction. Front end parts of the individual terminal accommodating portions 37 project forward from the fitting 34. Further, the individual terminal accommodating portions 37 are fit respectively into the device-side cavities 84 of the inner tube 83 when the fitting 34 and the device-side housing 81 are fit together.

The female terminal 20 and the rubber plug G can be accommodated individually into the individual terminal accommodating portion 37 from behind. When the female terminal 20 and the rubber plug G are accommodated into the individual terminal accommodating portion 37, a locking lance 37A provided in the individual terminal accommodating portion 37 retains the female terminal 20 and water is stopped between the individual terminal accommodating portion 37 and the shielded cable 25 by the rubber plug G. Thus, when the waterproof connector 10 and the device-side connector 80 are connected and the individual terminal accommodating portions 37 are fit into the device-side cavities 84 of the inner tube 83, the male terminals 85 enter the terminal connecting portions 21 through the individual terminal accommodating portions 37 and the female terminals 20 and the male terminals 85 are connected electrically, as shown in FIG. 5.

As shown in FIGS. 3 to 6, an annular individual seal ring (an example of an "individual resilient member" and an "individual seal member") 38 is fit on the outer peripheral surface of each individual terminal accommodating portion 37 and is retained by a front cap FC.

The individual seal ring 38 is made of an oil-containing resilient material. Outer peripheral lips 38A are provided on the outer peripheral surface of the individual seal ring 38 and inner peripheral lips 38B are provided on the inner peripheral surface of the individual seal ring 38. When the individual terminal accommodating portion 37 is fit into the device-side cavity 84, the outer peripheral lips 38A of the individual seal ring 38 are held resiliently in close contact with the inner peripheral surface of the device-side cavity 84 over the entire periphery and the inner peripheral lips 38B of the individual seal ring 38 are held resiliently in close contact with the outer peripheral surface of the individual terminal accommodating portion 37 over the entire periphery. In this way, the individual seal ring 38 stops water from entering between the inner peripheral surface of the device-side cavity 84 and the outer peripheral surface of the individual terminal accommodating portion 37.

As shown in FIGS. 3 to 6, a part of the housing body 32 arranged behind the receptacle 31 serves as a wire accommodating portion 39 for collectively accommodating a plurality of shielded cables 25 pulled out rearward from the individual terminal accommodating portions 37.

A caulk ring 40 made of metal and connected to the braided wire 28 exposed on the end of the shielded cable 25 is fit on the outer periphery of each shielded cable 25 arranged in the wire accommodating portion 39. The caulk ring 40 is formed into a stepped cylindrical shape having a larger diameter in a rear part than in a front part, and the rear part of the caulk ring 40 is connected to the shield shell 50 made of metal.

The shield shell 50 is formed, for example, by press-working a metal plate material excellent in conductivity. As shown in FIGS. 3 to 6, the shield shell 50 includes a shell body 51 in the form of a rectangular tube arranged along the inner peripheral surface of the housing body 32 and long in the front-rear direction. The shell body 51 is formed to cover from substantially central parts of the individual terminal accommodating portions 37 in the front-rear direction to the caulk rings 40 from outside. In other words, the shell body 51 is arranged from a substantially central part of the fitting 34 in the front-rear direction to the wire accommodating portion 39 while collectively surrounding rear parts of the individual terminal accommodating portions 37 accommodating the female terminals 20.

As shown in FIGS. 3 and 5, two pairs of upper and lower resilient pieces 52 are formed side by side in the lateral direction in a rear part of the shell body 51 for vertically sandwiching the respective caulk rings 40 connected to the shielded cables 25. Each resilient piece 52 is cantilevered rearward and is resiliently displaceable in an in-out direction of the shell body 51.

Further, each resilient piece 52 has a chevron shape by being bent outwardly after projecting more inwardly of the shell body 51 toward a rear side from the substantially central part of the shell body 51 in the front-rear direction. A top part of the chevron shape of each resilient piece 52 serves as a ring contact portion 52A configured to contact the caulk ring 40. The shield shell 50 is connected electrically to the braided wire 28 of the shielded cable 25 via the caulk ring 40 by the ring contact portion 52A resiliently contacting the outer peripheral surface of the caulk ring 40.

Further, as shown in FIGS. 3 and 4, a shell contact portion 51A is provided on the inner surface of a front end part of the shell body 51 and is capable of contacting the outer peripheral surface of the device-side shell 87 of the device-side connector 80. The shell contact portion 51A projects inwardly at the position of a substantially central part of the fitting 34 in the front-rear direction. When the fitting 34 is fit between the outer tube 82 and the inner tube 83 of the device-side housing 81 and the device-side shell 87 of the device-side connector 80 is arranged in the shell body 51, the shell contact portion 51A contacts the outer peripheral surface of the device-side connector 87. In this way, the device-side shell 87 and the shield shell 50 are connected electrically for electromagnetically shielding an area where the individual terminal accommodating portions 37 and the caulk rings 40 are arranged.

As shown in FIGS. 3 to 6, a one-piece rubber plug 41 is mounted in a rear part of the wire accommodating portion 39 for stopping water between the inner peripheral surface of the wire accommodating portion 39 and the outer peripheral surfaces of the respective shielded cable 25. The one-piece rubber plug 41 is fit in a rear end part of the wire accommodating portion 39 with the plurality of shielded cables 25 inserted therethrough in the front-rear direction, and is prevented from coming off rearward by a cap-shaped rubber plug holder 42 mounted on the rear end part of the wire accommodating portion 39.

The connector seal ring 36 fit on the outer peripheral surface of the fitting 34 is arranged on a rear end part of the fitting 34, and the individual seal rings 38 fit on the outer peripheral surfaces of the individual terminal accommodating portions 37 are arranged at positions slightly more forward than substantially central parts of the individual terminal accommodating portions 37 in the front-rear direction and inside the seal presser 35 mounted on the fitting 34. Further, the connector seal ring 36 and the individual seal rings 38 are arranged in areas at both front and rear sides of a position where the device-side shell 87 and the shell contact portion 51A in the shell body 51 of the shield shell 50 are in contact.

In other words, the connector seal ring 36 and the individual seal rings 38 are displaced large distances in the front-rear direction, which is a connecting direction. More particularly, the connector seal ring 36 is arranged in a rear end part, which is one end part of an area where the fitting 34 is arranged, and the individual seal rings 38 are arranged in a front end part, which is the other end part of the area where the fitting 34 is arranged.

Accordingly, when the waterproof connector 10 and the device-side connector 80 are connected, the connector seal ring 36 is held resiliently in close contact with the waterproof connector 10 and the device-side connector 80 in the rear end part of the area where the fitting 34 is arranged, and the individual seal rings 38 are held resiliently in close contact with the waterproof connector 10 and the device-side connector 80 in the front end part of the area where the fitting 34 is arranged. That is, the connector seal ring 36 or the individual seal rings 38 are held resiliently in close contact with the waterproof connector 10 and the device-side connector 80 in the front end part and the rear end part of the area where the fitting 34 is arranged, i.e. at two front and rear positions.

This embodiment is configured as described above. Next, functions and effects in connecting the waterproof connector 10 and the device-side connector 80 are described.

First, the waterproof connector 10 and the device-side connector 80 are arranged opposite to each other as shown in FIGS. 3 and 4, and are connected, as shown in FIGS. 5 and 6, by being brought closer to each other.

In the process of connecting the waterproof connector 10 and the device-side connector 80, the individual terminal accommodating portions 37 first are inserted into the device-side cavities 85 in the inner tube 83 of the device-side connector 80 and the outer tube 82 of the device-side connector 80 is inserted into the receptacle 31. When a connecting operation is continued, the fitting 34 is fit between the outer tube 82 and the inner tube 83 as the outer tube 82 is fit between the receptacle 31 and the fitting 34. In this way, as shown in FIG. 5, the male terminals 85 are inserted into the terminal connecting portions 21 and the female terminals 20 and the male terminals 85 are connected electrically.

Further, when the waterproof connector 10 and the device-side connector 80 are connected properly, the connector seal ring 36 is held resiliently in close contact with the inner peripheral surface of the front end of the outer tube 82 and the outer peripheral surface of the rear end of the fitting 34 over the entire periphery, and the individual seal rings 38 are held resiliently in close contact with the inner peripheral surfaces of the device-side cavities 84 and the outer peripheral surfaces of the individual terminal accommodating portions 37 over the entire periphery, as shown in FIGS. 5 and 6. In this way, water is stopped between the outer tube 82 and the fitting 34 and between the inner tube 83 and the individual terminal accommodating portions 38. Thus, the interiors of the individual terminal accommodating portions 37 are waterproofed doubly. Further, water is stopped between electrodes by the individual seal rings 38, for example, even if water intrudes into the fitting 34 before connection. Thus, a short circuit between the female terminals 20 can be prevented.

Further, when the waterproof connector 10 and the device-side connector 80 are connected properly, the lock 86 of the device-side connector 80 and the lock arm 33 of the waterproof connector 10 are locked in the front-rear direction and the waterproof connector 10 and the device-side connector 80 are locked in the connected state, as shown in FIG. 5.

For example, in the case of a waterproof connector including only a connector seal or a waterproof connector including only individual seal rings, the seal ring(s) is/are held in close contact with a device-side connector and the waterproof connector only at one position. Thus, if vibration from a device is transmitted to the connectors, the device-side connector and the waterproof connector wrench and rattle each other with the position of the seal ring(s) acting as a fulcrum, and contact parts between male terminals of the device-side connector and female terminals of the waterproof connector may slide and abrade.

However, according to this configuration, the individual seal rings 38 and the connector seal ring 36 are held resiliently in close contact with the waterproof connector 10 and the device-side connector 80 at two front and rear positions between the waterproof connector 10 and the device-side connector 80. Thus, the waterproof connector 10 and the device-side connector 80 can be prevented from wrenching and rattling each other. In this way, the abrasion of the contact parts between the male terminals 85 and the resilient contact pieces 23 of the female terminals 20 can be prevented.

Further, according to this embodiment, the individual seal rings 38 and the connector seal ring 36 are arranged at distant positions largely displaced in the front-rear direction in the front end part and the rear end part of the area where the fitting 34 is arranged. Thus, the rattling of the waterproof connector 10 and the device-side connector 80 can be prevented more reliably, for example, as compared to the case where individual seal rings and a connector seal ring are arranged proximately in the front-rear direction or arranged to overlap radially.

Further, according to this embodiment, the rattling of the waterproof connector 10 and the device-side connector 80 is prevented by arranging the individual seal rings 38 and the connector seal ring 36 in the areas at both front and rear sides (both sides in the connecting direction) of the position where the device-side shell 87 and the shell contact portion 51A of the shield shell 50 are in contact. Thus, the device-side shell 87 and the shell contact portion 51A can be prevented from sliding and will not abrade. That is, displacing the individual seal rings 38 and the connector seal ring 36 large amounts in the front-rear direction is very effective for preventing the waterproof connector 10, including the shield shell 50, from rattling relative to the device-side connector 80.

As described above, according to this embodiment, the individual seal rings 38 or the connector seal ring 36 are held resiliently in close contact with the waterproof connector 10 and the device-side connector 80 at two front and rear positions between the waterproof connector 10 and the device-side connector 80 spaced largel distances in the front-rear direction in the front end part and the rear end part of the area where the fitting 34 is arranged. Thus, the waterproof connector 10 and the device-side connector 80 can be prevented from wrenching and rattling each other. In this way, the abrasion of the contact parts between the male terminals 85 and the resilient contact pieces 23 of the female terminals 20 can be prevented.

Further, according to this embodiment, the connector seal ring 36, configured to stop water between the outer tube 82 and the fitting 34, and the individual seal rings 38, configured to stop water between the inner peripheral surfaces of the device-side cavities 84 and the individual terminal accommodating portions 37, are used also as rattling suppressing members for preventing rattling between the waterproof connector 10 and the device-side connector 80. Thus, the number of components can be reduced as compared to the case where a separate rattling suppressing member is provided between the waterproof connector 10 and the device-side connector 80.

Further, since the individual seal rings 38 and the connector seal ring 36 are displaced in the front-rear direction, connection resistance is dispersed when connecting the waterproof connector 10 and the device-side connector 80, for example, as compared to the case where individual seal rings and a connector seal ring are arranged at the same position in the front-rear direction.

Further, according to this embodiment, the rattling of the waterproof connector 10 and the device-side connector 80 is prevented by arranging the individual seal rings 38 and the connector seal ring 36 in the areas at both front and rear sides of the position where the device-side shell 87 and the shell contact portion 51A of the shield shell 50 are in contact. Thus, not only the contact parts between the male terminals 85 and the female terminals 20, but also the device-side shell 87 and the shell contact portion 51A can be prevented from sliding and abrasion. That is, in waterproof connectors including a shield shell as in this embodiment, it is very effective to displace individual seal rings and a connector seal ring in the front-rear direction.

The technique disclosed in this specification is not limited to the above described and illustrated embodiment. For example, the following various modes are also included.

In the above embodiment, the connector seal ring is arranged behind the individual seal rings. However, there is no limitation to this and the connector seal ring may be arranged before the individual seal rings.

In the above embodiment, the device-side shell and the shell contact portion are in contact at the position behind the individual seal rings and before the connector seal ring. However, there is no limitation to this and the device-side shell and the shell contact portion may be in contact at the position before the individual seal rings or behind the individual seal rings.

In the above embodiment, the individual seal rings 38 are held resiliently in close contact with the inner peripheral surfaces of the device-side cavities 84 and the outer peripheral surfaces of the individual terminal accommodating portions 37 over the entire periphery, and the connector seal ring 36 is held resiliently in close contact with the inner peripheral surface of the outer tube 82 and the outer peripheral surface of the fitting 34 over the entire periphery. However, there is no limitation to this and individual seal rings may be held resiliently in close contact with the inner peripheral surfaces of the device-side cavities 84 and parts of the outer peripheral surfaces of the individual terminal accommodating portions 37 and a connector seal ring may be held resiliently in close contact with the inner peripheral surface of the outer tube 82 and a part of the outer peripheral surface of the fitting 34 or either the individual seal rings or the connector seal ring may be partially resiliently held in close contact.

In the above embodiment, the waterproof connector including the shield shell is illustrated as an example. However, there is no limitation to this and the technique disclosed in this specification may be applied to waterproof connectors including no shield shell and connectors having no waterproof function.

LIST OF REFERENCE SIGNS

10: waterproof connector (connector)
20: female terminal (terminal)
30: housing
34: fitting
36: connector seal ring (connector resilient member, connector seal member)
37: individual terminal accommodating portion
38: individual seal ring (individual resilient member, individual seal member)
50: shield shell
80: device-side connector (mating connector)
84: device-side cavity (mating cavity)
85: male terminal (mating terminal)
87: device-side shell (mating shell)

The invention claimed is:

1. A connector connectable to a mating connector, comprising:

a housing including a fitting with a front end configured to fit into the mating connector in a forward to backward direction;

a connector resilient member fit on an outer peripheral surface of the fitting at a position spaced rearward of the front end and configured to be held resiliently in close contact with an inner peripheral surface of the mating connector and the fitting when the fitting is fit into the mating connector;

a plurality of individual terminal accommodating portions provided in the housing and configured to accommodate terminals to be connected to mating terminals that are fit respectively into a plurality of mating cavities provided in the mating connector; and a plurality of individual resilient members separate from the connector resilient member and fit on outer peripheral surfaces of the individual terminal accommodating portions at positions spaced forward from the connector resilient member in the forward to backward direction, the individual resilient members being configured to be held resiliently in close contact with inner peripheral surfaces of the mating cavities and the individual terminal accommodating portions when the individual terminal accommodating portions are fit into the mating cavities.

2. The connector of claim 1, wherein:

the connector resilient member is a connector seal made of a resilient material and configured to stop water between the mating connector and the fitting by being resiliently held in close contact with the mating connector and the fitting over the entire periphery; and each of the plurality of individual resilient members is an individual seal made of a resilient material and configured to stop water between the inner peripheral surface of the mating cavity and the individual terminal accommodating portion by being held resiliently in close contact with the inner peripheral surface of the mating cavity and the individual terminal accommodating portion over the entire periphery.

3. The connector of claim 1, wherein the fitting has opposite front and back ends spaced apart in the forward to backward direction, and the connector resilient member is aligned with the back end of the fitting and the plurality of individual resilient members are aligned with the front end of the fitting.

4. The connector of claim 1, further comprising:

a shield shell held in contact with a mating shell provided in the mating connector wherein the connector resilient member and the plurality of individual resilient members are arranged on opposite ends of a position where the shield shell and the mating shell contact each other in the forward to backward direction.

* * * * *